US010508538B2

(12) United States Patent
Stack et al.

(10) Patent No.: US 10,508,538 B2
(45) Date of Patent: Dec. 17, 2019

(54) FLUID PRESSURE PULSE GENERATOR FOR A DOWNHOLE TELEMETRY TOOL

(71) Applicant: Evolution Engineering Inc., Calgary, Alberta (CA)

(72) Inventors: Luke Stack, Calgary (CA); Aaron W. Logan, Calgary (CA); Justin C. Logan, Calgary (CA); Gavin Gaw-Wae Lee, Calgary (CA)

(73) Assignee: EVOLUTION ENGINEERING INC., Calgary, Alberta (CA)

( * ) Notice: Subject to any disclaimer, the term of this patent is extended or adjusted under 35 U.S.C. 154(b) by 0 days.

(21) Appl. No.: 15/532,034

(22) PCT Filed: Dec. 1, 2015

(86) PCT No.: PCT/CA2015/051251

§ 371 (c)(1),
(2) Date: May 31, 2017

(87) PCT Pub. No.: WO2016/086298

PCT Pub. Date: Jun. 9, 2016

(65) Prior Publication Data

US 2017/0260853 A1 Sep. 14, 2017

Related U.S. Application Data

(60) Provisional application No. 62/086,055, filed on Dec. 1, 2014, provisional application No. 62/111,342, filed on Feb. 3, 2015.

(51) Int. Cl.
*E21B 47/18* (2012.01)
*F01C 1/02* (2006.01)

(52) U.S. Cl.
CPC ..... *E21B 47/187* (2013.01); *E21B 47/182* (2013.01); *F01C 1/02* (2013.01)

(58) Field of Classification Search
CPC ..... E21B 47/187; E21B 44/00; F01C 1/02; F16K 3/04; F16K 47/08
See application file for complete search history.

(56) References Cited

U.S. PATENT DOCUMENTS 2,990,895 A * 7/1961 Works ..... E21B 4/02 175/107
3,739,331 A 6/1973 Godbey et al.
(Continued)

FOREIGN PATENT DOCUMENTS

CA 1299998 5/1992
CA 2868006 9/2013
(Continued)

*Primary Examiner* — James J Yang
*Assistant Examiner* — Kevin Lau
(74) *Attorney, Agent, or Firm* — D'Ambrosio & Menon, PLLC; Usha Menon

(57) ABSTRACT

A fluid pressure pulse generator for a downhole telemetry tool comprising a stator and a rotor. The stator comprises a stator flow diverter radially extending across a flow path for fluid flowing through the fluid pressure pulse generator and having one or more than one stator flow channel therethrough through which the fluid flows. The rotor comprises a rotor flow diverter radially extending across the flow path for fluid flowing through the fluid pressure pulse generator and having one or more than one rotor flow channel therethrough through which the fluid flows. The rotor flow diverter is axially adjacent the stator flow diverter and the rotor flow diverter is rotatable relative to the stator flow diverter to move the one or more than one rotor flow channel in and out of fluid communication with the one or more than one stator flow channel to create fluid pressure pulses in the fluid flowing through the fluid pressure pulse generator. A rotor/driveshaft coupling releasably couples the driveshaft of a probe of the tool and the rotor such that the probe can
(Continued)

be decoupled from the rotor and removed from a sub housing the fluid pressure pulse generator.

36 Claims, 11 Drawing Sheets

(56) References Cited

U.S. PATENT DOCUMENTS

| | | | | |
|---|---|---|---|---|
| 4,396,071 | A | 8/1983 | Stephens | |
| 4,491,738 | A | 1/1985 | Kamp | |
| 4,725,197 | A | 2/1988 | Russell et al. | |
| 4,914,637 | A * | 4/1990 | Goodsman | E21B 47/18 367/83 |
| 5,159,446 | A * | 10/1992 | Hibino | A61B 1/00039 348/65 |
| 5,370,514 | A | 12/1994 | Morita et al. | |
| 5,586,083 | A * | 12/1996 | Chin | E21B 47/18 175/48 |
| 7,423,932 | B1 | 9/2008 | Jeter | |
| 2011/0011594 | A1* | 1/2011 | Young | E21B 47/187 166/321 |
| 2013/0250728 | A1* | 9/2013 | Burgess | E21B 47/187 367/84 |
| 2014/0231096 | A1* | 8/2014 | Eddison | E21B 23/04 166/374 |

FOREIGN PATENT DOCUMENTS

| | | |
|---|---|---|
| CA | 2894621 | 6/2014 |
| CA | 2888922 | 7/2014 |

* cited by examiner

FLUID PRESSURE PULSE GENERATOR FOR A DOWNHOLE TELEMETRY TOOL

FIELD

This disclosure relates generally to a fluid pressure pulse generator for a downhole telemetry tool, such as a mud pulse telemetry measurement-while-drilling ("MWD") tool.

BACKGROUND

The recovery of hydrocarbons from subterranean zones relies on the process of drilling wellbores. The process includes drilling equipment situated at surface, and a drill string extending from the surface equipment to a below-surface formation or subterranean zone of interest. The terminal end of the drill string includes a drill bit for drilling (or extending) the wellbore. The process also involves a drilling fluid system, which in most cases uses a drilling "mud" that is pumped through the inside of piping of the drill string to cool and lubricate the drill bit. The mud exits the drill string via the drill bit and returns to surface carrying rock cuttings produced by the drilling operation. The mud also helps control bottom hole pressure and prevent hydrocarbon influx from the formation into the wellbore, which can potentially cause a blow out at surface.

Directional drilling is the process of steering a well from vertical to intersect a target endpoint or follow a prescribed path. At the terminal end of the drill string is a bottom-hole-assembly ("BHA") which comprises 1) the drill bit; 2) a steerable downhole mud motor of a rotary steerable system; 3) sensors of survey equipment used in logging-while-drilling ("LWD") and/or measurement-while-drilling ("MWD") to evaluate downhole conditions as drilling progresses; 4) means for telemetering data to surface; and 5) other control equipment such as stabilizers or heavy weight subs. The BHA is conveyed into the wellbore by a string of metallic tubulars (i.e. drill pipe).

MWD equipment is used while drilling to provide downhole sensor and status information to surface in a near real-time mode. This information is used by a rig operator to make decisions about controlling and steering the well to optimize the drilling speed and trajectory based on numerous factors, including lease boundaries, existing wells, formation properties, and hydrocarbon size and location. The rig operator can make intentional deviations from the planned wellbore path as necessary based on the information gathered from the downhole sensors during the drilling process. The ability to obtain near real-time MWD data allows for a relatively more economical and more efficient drilling operation.

One type of downhole MWD telemetry known as mud pulse telemetry involves creating pressure waves ("pulses") in the drill mud circulating through the drill string. Mud is circulated from surface to downhole using positive displacement pumps. The resulting flow rate of mud is typically constant. The pressure pulses are achieved by changing the flow area and/or path of the drilling fluid in a timed, coded sequence as it passes the MWD tool, thereby creating pressure differentials in the drilling fluid. The pressure differentials or pulses may be either negative pulses or positive pulses. Valves that open and close a bypass stream from inside the drill pipe to the wellbore annulus create a negative pressure pulse. All negative pulsing valves need a high differential pressure below the valve to create a sufficient pressure drop when the valve is open, but this results in the negative valves being more prone to washing. With each actuation, the valve hits against the valve seat and needs to ensure it completely closes the bypass; the impact can lead to mechanical and abrasive wear and failure. Valves that use a controlled restriction within the circulating mud stream create a positive pressure pulse. Pulse frequency is typically governed by pulse generator motor speed changes. The pulse generator motor requires electrical connectivity with the other elements of the MWD probe.

One type of valve mechanism used to create mud pulses is a rotor and stator combination where a rotor can be rotated relative to the fixed stator between an opened position where there is no restriction of mud flowing through the valve and no pulse is generated, and a restricted flow position where there is restriction of mud flowing through the valve and a pressure pulse is generated.

SUMMARY

According to a first aspect there is provided a fluid pressure pulse generator for a downhole telemetry tool comprising a stator and a rotor. The stator comprises a stator flow diverter radially extending across a flow path for fluid flowing through the fluid pressure pulse generator and having one or more than one stator flow channel therethrough through which the fluid flows. The rotor comprises: a rotor flow diverter radially extending across the flow path for fluid flowing through the fluid pressure pulse generator and having one or more than one rotor flow channel therethrough through which the fluid flows; and one of a rotor male shaft or a rotor female receiver configured to respectively releasably mate with a driveshaft female receiver or a driveshaft male shaft of a driveshaft of a probe of the downhole telemetry tool to releasably couple the driveshaft with the rotor. The rotor flow diverter is axially adjacent the stator flow diverter and the rotor flow diverter is rotatable relative to the stator flow diverter to move the one or more than one rotor flow channel in and out of fluid communication with the one or more than one stator flow channel to create fluid pressure pulses in the fluid flowing through the fluid pressure pulse generator.

The rotor may comprise the rotor female receiver having an internal profile which corresponds to an external profile of the driveshaft male shaft.

The rotor may further comprise a rotor body and the rotor flow diverter may comprise a plurality of radially extending rotor projections spaced around the rotor body, whereby adjacently spaced rotor projections define the rotor flow channels therebetween.

The rotor flow diverter may comprise a rotor disc with the one or more than one rotor flow channel extending therethrough.

The rotor flow diverter may further comprise one or more than one turbine flow channel therethrough, wherein the one or more than one turbine flow channel is angled relative to the axis of rotation of the rotor such that fluid flowing through the one or more than one turbine flow channel causes the rotor to rotate. The rotor flow diverter may comprise a rotor disc with the one or more than one rotor flow channel extending therethrough and a plurality of turbine projections spaced around a circumference of the rotor disc, whereby adjacently spaced turbine projections define the turbine flow channels therebetween.

One or more of the one or more than one rotor flow channel may be angled relative to the axis of rotation of the rotor such that fluid flowing through the one or more than one rotor flow channel causes the rotor to rotate.

The rotor may further comprise a longitudinally extending rotor shaft which is received in a bore extending through the stator. The fluid pressure pulse generator may further comprise a fastener configured to fasten to the rotor shaft to retain the rotor shaft in the bore while allowing rotation of the rotor shaft within the bore. The fastener may be configured to releasably fasten to the rotor shaft. The fastener may be a threaded nut and the rotor shaft may be threaded to receive the threaded nut.

The stator may further comprise a stator body and the stator flow diverter may comprise a plurality of radially extending stator projections spaced around the stator body, whereby adjacently spaced stator projections define the stator flow channels therebetween. The fluid pressure pulse generator may further comprise a spider configured to extend between the stator body and a sub when the downhole telemetry tool is downhole, the spider comprising a plurality of apertures for flow of fluid therethrough. The fluid pressure pulse generator may further comprise a castle nut for releasably securing the spider to the sub.

The stator flow diverter may comprise a stator disc with the one or more than one stator flow channel extending therethrough. The fluid pressure pulse generator may further comprise a castle nut for releasably securing the stator disc to a sub when the downhole telemetry tool is downhole.

According to another aspect, there is provided a downhole telemetry tool comprising a probe and a fluid pressure pulse generator. The probe comprises: a housing enclosing a motor and gearbox subassembly; and a driveshaft having a first end coupled with the motor and gearbox subassembly and an opposed second end extending out of the housing and comprising a driveshaft female receiver or a driveshaft male shaft. The fluid pressure pulse generator comprises a stator and a rotor. The stator comprises a stator flow diverter radially extending across a flow path for fluid flowing through the fluid pressure pulse generator and having one or more than one stator flow channel therethrough through which the fluid flows. The rotor comprises: a rotor flow diverter radially extending across the flow path for fluid flowing through the fluid pressure pulse generator and having one or more than one rotor flow channel therethrough through which the fluid flows; and a rotor male shaft or a rotor female receiver. The rotor flow diverter is axially adjacent the stator flow diverter and the rotor flow diverter is rotatable relative to the stator flow diverter to move the one or more than one rotor flow channel in and out of fluid communication with the one or more than one stator flow channel to create fluid pressure pulses in the fluid flowing through the fluid pressure pulse generator. The probe comprises the driveshaft male shaft and the rotor comprises the rotor female receiver, or the probe comprises the driveshaft female receiver and the rotor comprises the rotor male shaft, whereby the driveshaft male shaft and the rotor female receiver or the driveshaft female receiver and the rotor male shaft releasably mate to releasably couple the driveshaft with the rotor.

The probe may comprise the driveshaft male shaft and the rotor may comprise the rotor female receiver and the rotor female receiver may have an internal profile which corresponds to an external profile of the driveshaft male shaft.

The rotor may further comprise a rotor body and the rotor flow diverter comprises a plurality of radially extending rotor projections spaced around the rotor body, whereby adjacently spaced rotor projections define the rotor flow channels therebetween.

The rotor flow diverter may comprise a rotor disc with the one or more than one rotor flow channel extending therethrough.

The rotor flow diverter may further comprise one or more than one turbine flow channel therethrough, wherein the one or more than one turbine flow channel is angled relative to the axis of rotation of the rotor such that fluid flowing through the one or more than one turbine flow channel causes the rotor to rotate. The rotor flow diverter may comprise a rotor disc with the one or more than one rotor flow channel extending therethrough and a plurality of turbine projections spaced around a circumference of the rotor disc, whereby adjacently spaced turbine projections define the turbine flow channels therebetween.

One or more of the one or more than one rotor flow channel may be angled relative to the axis of rotation of the rotor such that fluid flowing through the one or more than one rotor flow channel causes the rotor to rotate.

The rotor may further comprise a longitudinally extending rotor shaft which is received in a bore extending through the stator. The downhole telemetry tool may further comprise a fastener configured to fasten to the rotor shaft to retain the rotor shaft in the bore while allowing rotation of the rotor shaft within the bore. The fastener may be configured to releasably fasten to the rotor shaft. The fastener may be a threaded nut and the rotor shaft may be threaded to receive the threaded nut.

The stator may further comprise a stator body and the stator flow diverter may comprise a plurality of radially extending stator projections spaced around the stator body, whereby adjacently spaced stator projections define the stator flow channels therebetween. The downhole telemetry tool may further comprise a stator spider configured to extend between the stator body and a sub when the downhole telemetry tool is downhole, the stator spider comprising a plurality of apertures for flow of fluid therethrough. The downhole telemetry tool may further comprise a stator castle nut for releasably securing the stator spider to the sub.

The stator flow diverter may comprise a stator disc with the one or more than one stator flow channel extending therethrough. The downhole telemetry tool may further comprise a stator castle nut for releasably securing the stator disc to a sub when the downhole telemetry tool is downhole.

The downhole telemetry tool may further comprise a probe spider configured to releasably receive and radially lock the probe, the probe spider comprising a plurality of apertures for flow of fluid therethrough. The downhole telemetry tool may further comprise a probe castle nut for releasably securing the probe spider downhole.

This summary does not necessarily describe the entire scope of all aspects. Other aspects, features and advantages will be apparent to those of ordinary skill in the art upon review of the following description of specific embodiments.

DETAILED DESCRIPTION OF EMBODIMENTS

Directional terms such as "uphole" and "downhole" are used in the following description for the purpose of providing relative reference only, and are not intended to suggest any limitations on how any apparatus is to be positioned during use, or to be mounted in an assembly or relative to an environment.

The embodiments described herein generally relate to a fluid pressure pulse generator of a measurement while drilling ("MWD") tool that can generate pressure pulses. The fluid pressure pulse generator may be used for mud pulse ("MP") telemetry used in downhole drilling, wherein a drilling fluid (herein referred to as "mud") is used to transmit telemetry pulses to surface. The fluid pressure pulse generator may alternatively be used in other methods where it is necessary to generate a fluid pressure pulse. The fluid pressure pulse generator comprises a fixed stator and a rotor which rotates relative to the fixed stator to generate pressure pulses in mud flowing through the fluid pressure pulse generator.

Figure 1:
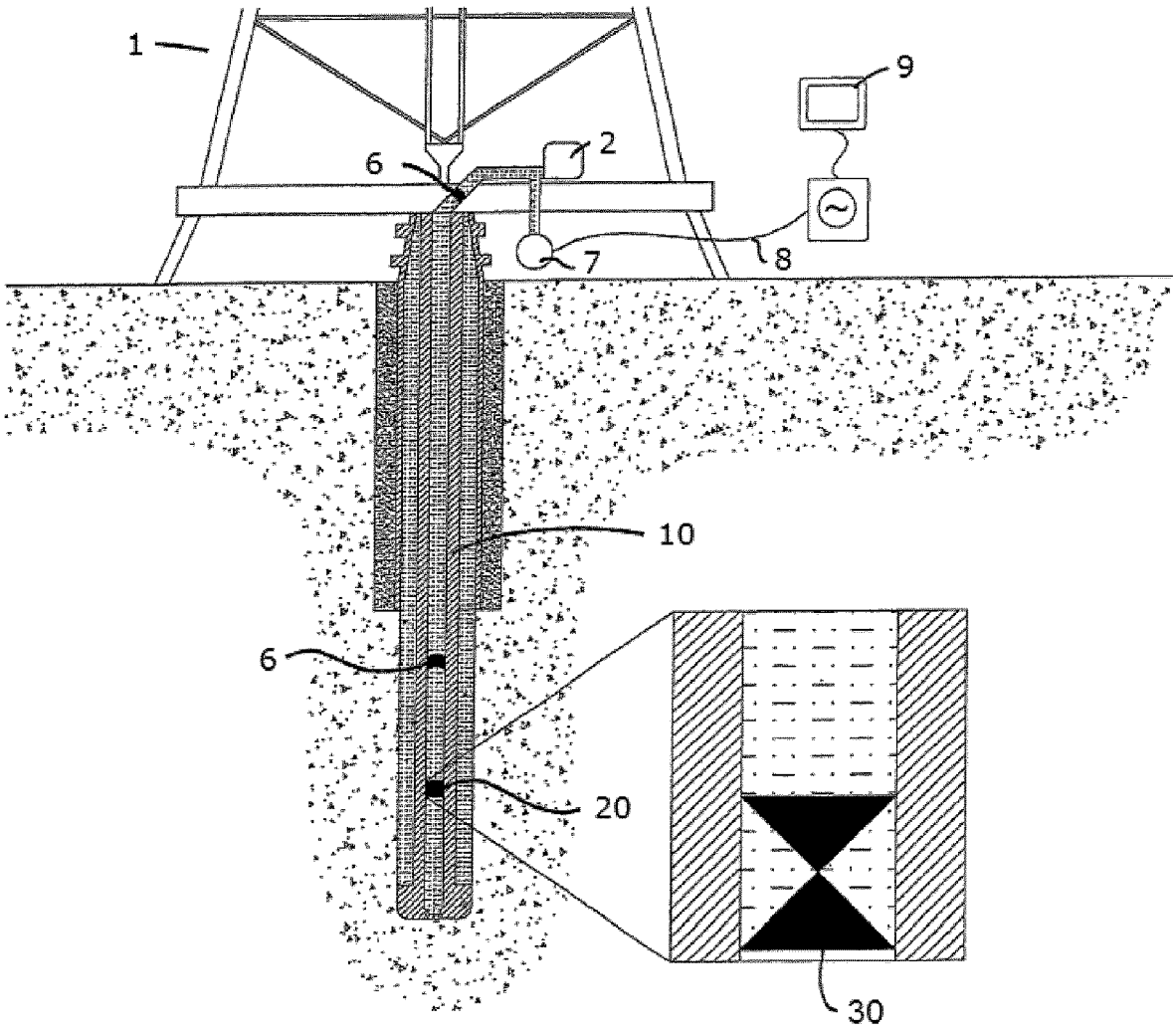
FIG. 1 is a schematic of a drill string in an oil and gas borehole comprising a MWD tool for transmission of telemetry data using pressure pulses.

Referring to the drawings and specifically to FIG. 1, there is shown a schematic representation of a MP telemetry operation using a MWD tool 20. In downhole drilling equipment 1, drilling mud is pumped down a drill string by pump 2 and passes through the MWD tool 20 which includes a fluid pressure pulse generator 30. The fluid pressure pulse generator 30 has an open position in which mud flows relatively unimpeded through the pressure pulse generator 30 and no pressure pulse is generated and a restricted flow position where flow of mud through the pressure pulse generator 30 is restricted and a positive pressure pulse is generated (represented schematically as block 6 in drill string 10). Information acquired by downhole sensors (not shown) is transmitted in specific time divisions by pressure pulses 6 in the drill string 10. More specifically, signals from sensor modules in the MWD tool 20, or in another downhole probe (not shown) communicative with the MWD tool 20, are received and processed in a data encoder in the MWD tool 20 where the data is digitally encoded as is well established in the art. This data is sent to a controller in the MWD tool 20 which then actuates the fluid pressure pulse generator 30 to generate pressure pulses 6 which contain the encoded data. The pressure pulses 6 are transmitted to the surface and detected by a surface pressure transducer 7 and decoded by a surface computer 9 communicative with the transducer by cable 8. The decoded signal can then be displayed by the computer 9 to a drilling operator. The characteristics of the pressure pulses 6 are defined by duration, shape, and frequency and these characteristics are used in various encoding systems to represent binary data.

Referring now to FIGS. 2 to 5 and 7 to 9, there is shown embodiments of a MWD tool 20 comprising the fluid pressure pulse generator 30 positioned at the downhole end of the MWD tool 20 and a probe 26 which takes measurements while drilling and controls the fluid pressure pulse generator 30. The fluid pressure pulse generator 30 and probe 26 are axially located inside a sub or collar 27. In FIGS. 2 to 5 and 7 to 9, the sub 27 is cut away to show the downhole end of the MWD tool 20; however, the sub 27 is a generally tubular sub-section of the drill string which houses the fluid pressure pulse generator 30. The fluid pressure pulse generator 30 comprises a stator 40 and a rotor 60 positioned between the stator 40 and the downhole end of the probe 26. The rotor 60 rotates relative to the fixed stator 40 to generate pressure pulses 6 as described below in more detail.

The rotor 60 comprises a generally frusto-conical rotor body 61 that tapers in the downhole direction, a rotor flow diverter comprising a rotor disc 62 extending radially around the downhole end of the rotor body 61, and a rotor shaft 64 extending longitudinally from the downhole end of the rotor body 61. The rotor body 61 includes a bore or female receiver 65 at is uphole end which receives a male shaft 24 at the downhole end of a driveshaft of the probe 26 to releasably couple the driveshaft and the rotor 60 as described in more detail below. The rotor disc 62 comprises a plurality of wedge shaped apertures (rotor flow channels 63) extending therethrough which are equidistantly spaced around the rotor disc 62 and a plurality of radially extending turbine projections 66 equally spaced around the circumference of the rotor disc 62. Each turbine projection 66 comprises an uphole surface and a downhole surface with two side walls extending therebetween. The side walls are each angled or sloped relative to the axis of rotation of the rotor 60 and define turbine flow channels 67 therebetween.

In the embodiment of the fluid pressure pulse generator 30 shown in FIGS. 2 to 5, the stator 40 comprises a stator body 41 with a bore 45 therethrough which receives the rotor shaft 64, and a stator flow diverter comprising a plurality of radially extending stator projections 42 spaced equidistant around the uphole end of the stator body 41. Each stator projection 42 is radially tapered and narrower at its proximal end attached to the stator body 41 than at its distal end. The stator projections 42 define wedge shaped stator flow channels 43 therebetween which correspond in number and dimensions to the rotor flow channels 63 of the rotor disc 62. Spider 28*b* extends radially from the stator body 41 and has a plurality of apertures therethrough allowing mud to flow between the stator body 41 and the sub 27. The outer profile of the stator body 41 tapers in the uphole direction between the spider 28*b* and the stator projections 42 and tapers in the downhole direction downhole of the spider 28*b*. In the embodiment of the fluid pressure pulse generator 30 shown in FIGS. 7 to 9, the stator 40 comprises a stator flow diverter comprising a stator disc 49 with a central bore 45 therethrough which receives the rotor shaft 64. The stator disc 49 includes a plurality of wedge shaped apertures (stator flow channels 43) therethrough which correspond in number and dimensions to the rotor flow channels 63.

To assemble the fluid pressure pulse generator 30, the rotor shaft 64 is received in the stator bore 45 and a threaded nut 25 threads onto a threaded downhole end 64*a* of the rotor shaft 64 to rotatably couple the rotor 60 to the stator 40 with the rotor flow diverter (rotor disc 62) axially adjacent the stator flow diverter (stator projections 42 or stator disc 49). The nut 25 is releasably coupled to the rotor shaft 64 and can be removed allowing disassembly of the fluid pressure pulse generator 30 for repair or replacement of the rotor 60 or stator 40 if they become damaged or worn. An alternative fastener may be used which is releasably or fixedly secured to the end of the rotor shaft 64 such that the rotor shaft 64 can rotate in the stator bore 45, for example, the nut 25 may be replaced by a clip, bolt or other fastener. In an alternative embodiment (not shown) the stator 40 may include a longitudinally extending stator shaft which is received in an aperture (bore) extending through the rotor 60 and a fastener (for example threaded nut 25) may be positioned in the rotor female receiver 65 and fastened to the stator shaft to couple the rotor 60 and the stator 40 such that the rotor 60 can rotate relative to the stator 40.

The assembled fluid pressure pulse generator 30 is inserted into the downhole end of the sub 27 and the spider 28*b* or the stator disc 49 abuts a downhole annular shoulder 22 on the internal surface of the sub 27. A castle nut 29*b* threads into the sub 27 and secures the spider 28*b* or stator disc 49 in position in the sub 27. Alternative means of fixing the stator 40 to the sub 27 may be used, for example the spider 28*b* or stator disc 49 may be press fitted to the sub 27.

Spider 28*a* comprises an inner circular wall 70 with a bore therethrough and an outer circular wall 71. Projections 72 extend radially between the inner wall 70 and the outer wall 71 and define a plurality of apertures which allow mud to flow between the probe 26 and the sub 27 when the probe 26 is positioned in the sub 27. The spider 28*a* is inserted into the uphole end of the sub 27 and abuts an uphole annular shoulder 23 on the internal surface of the sub 27. A castle nut 29*a* threads into the sub 27 and secures the spider 28*a* in position in the sub 27. Alternative means of fixing the spider 28*a* to the sub 27 may be used, for example the spider 28*a* may be press fitted to the sub 27.

The probe 26 is received in the bore of the spider 28*a*. The male shaft 24 at the downhole end of the driveshaft of the probe 26 releasably mates with the female receiver 65 in the rotor body 61 as described in more detail below. A key 21 (shown in FIGS. 3*b* and 8) on the external surface of the probe 26 is received in a keyway or notch 73 in the internal surface of the inner circular wall 70 of the spider 28*a* and radially locks the probe 26 to the spider 28*a* preventing the probe 26 from rotating relative to the sub 27. The probe 26 can be easily removed from the sub 27 by moving the probe 26 in the uphole direction relative to the sub 27.

Figure 4:
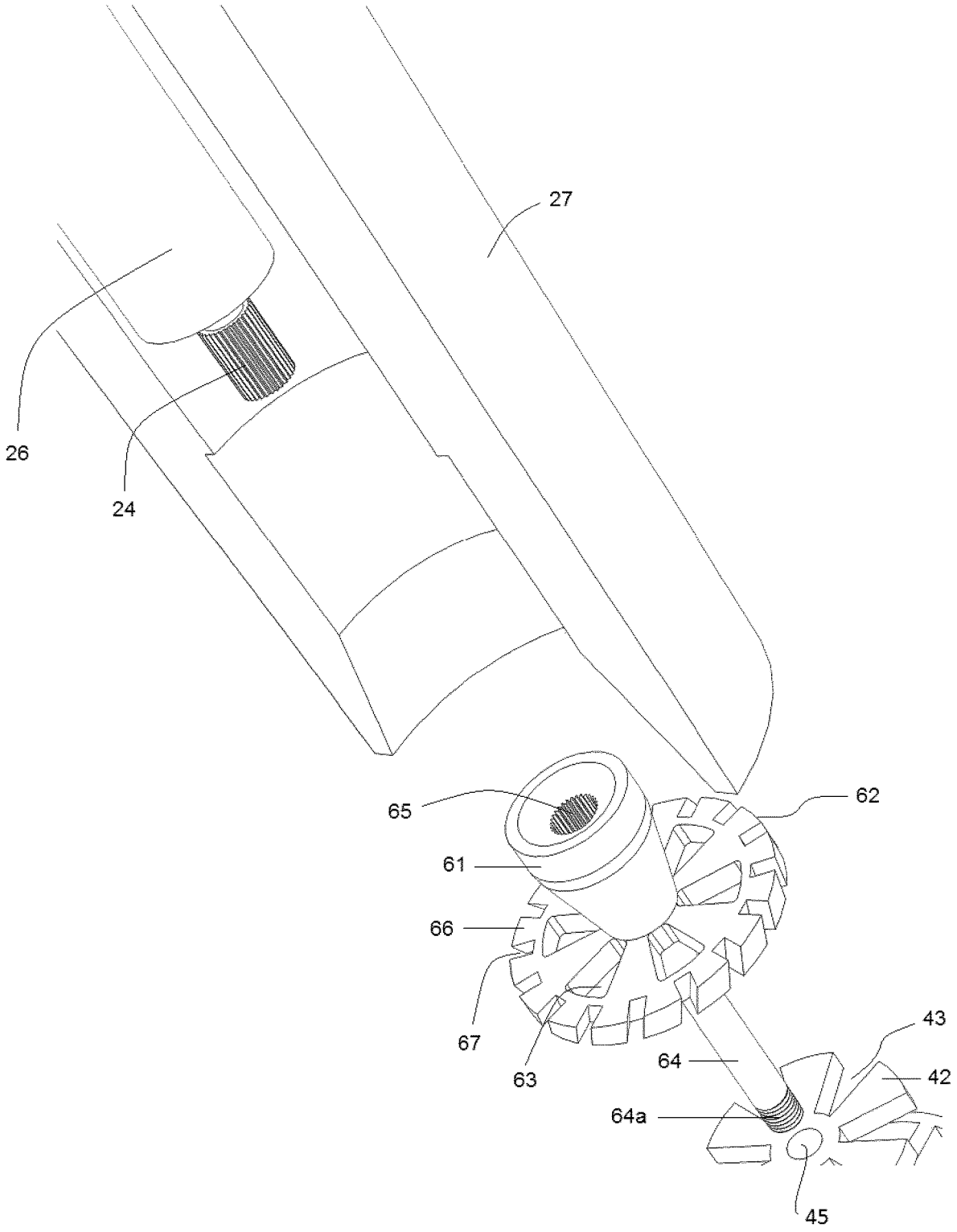
FIG. 4 is a perspective view of a section of the expanded MWD tool.
Figure 8:
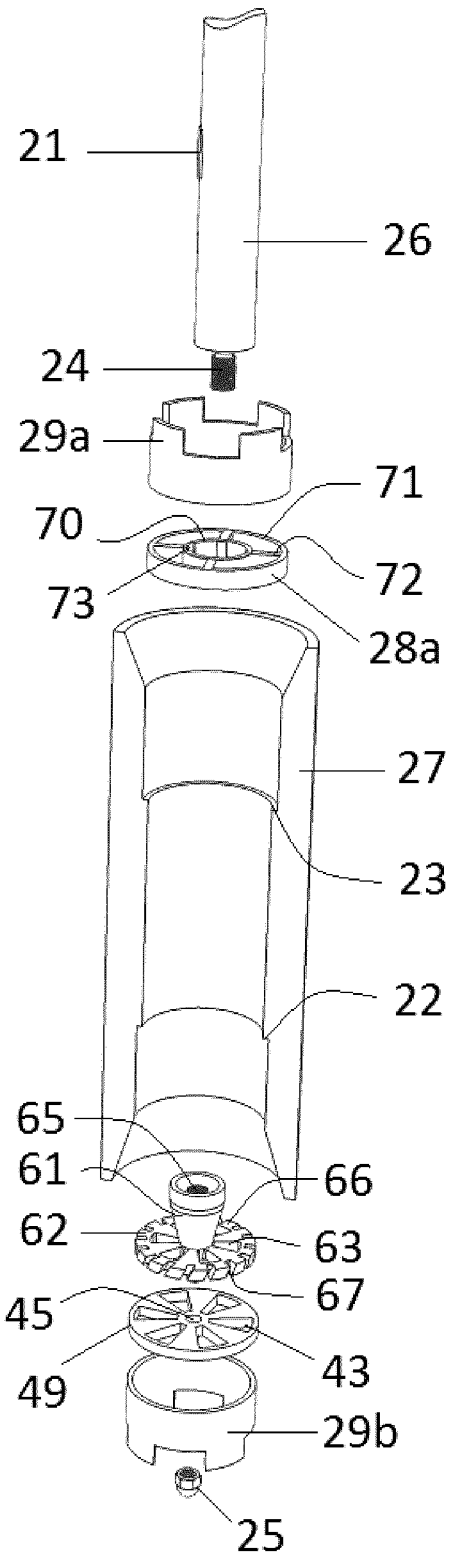
FIG. 8 is a side view of the expanded MWD tool of FIG. 7.
Figure 9:
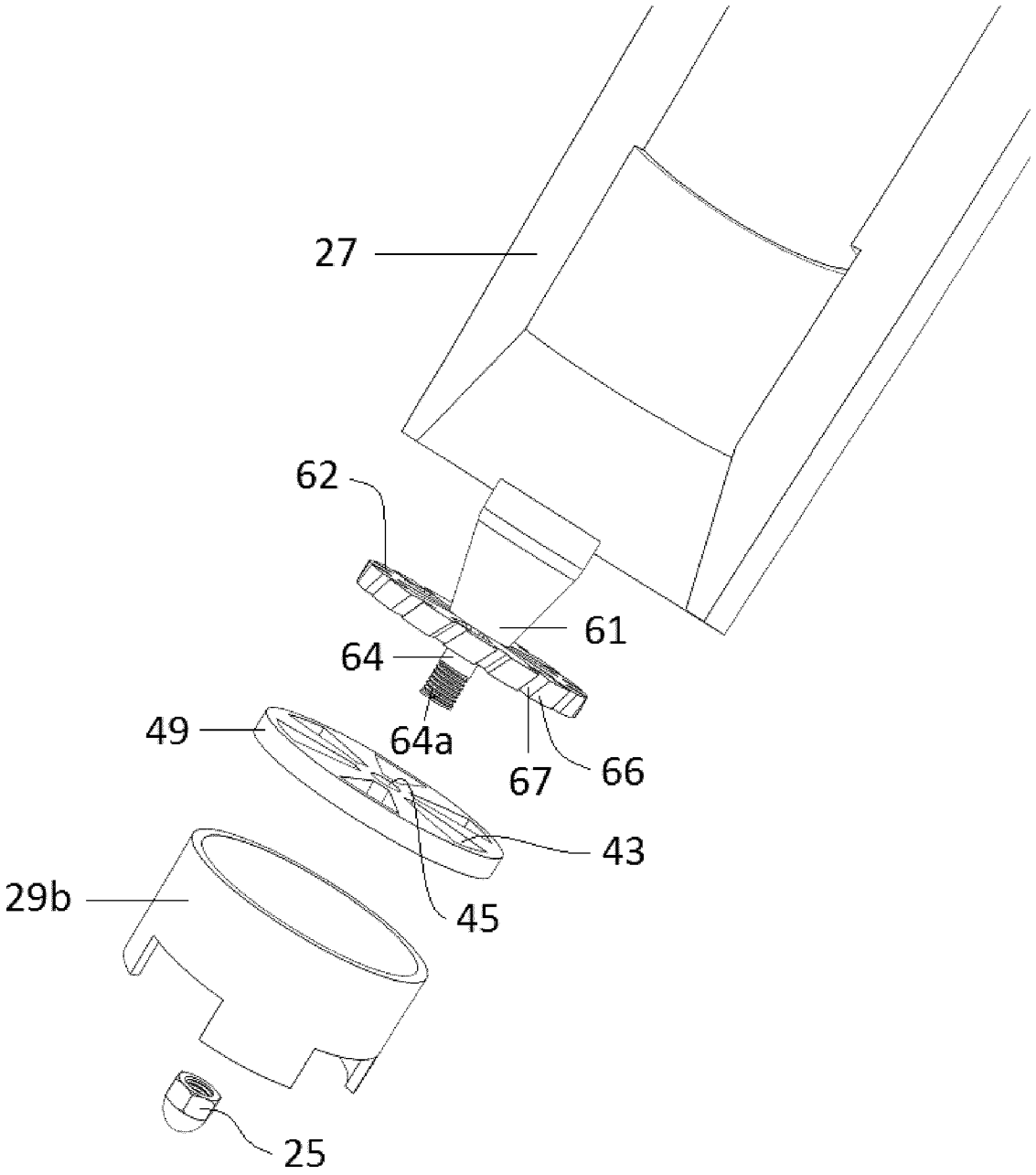
FIG. 9 is a perspective view of a section of the expanded MWD tool of FIG. 8.

As shown in FIGS. 4 and 8, the female receiver 65 in the rotor body 61 includes a plurality of internal ridges or teeth defining grooves or slots therebetween which extend around the wall of the female receiver 65. The internal teeth are equally spaced around the wall of the female receiver 65 and are parallel to the axis of rotation of the rotor 60. Each tooth has straight sides and is of equal thickness along its length. The male shaft 24 may be part of the driveshaft or fixed to the downhole end of the driveshaft of the probe 26 and comprises a plurality of external ridges or teeth defining grooves therebetween which are equally spaced around the circumference of the male shaft 24. The external teeth and grooves of the male shaft 24 are parallel to the axis of rotation of the rotor 60 and correspond in shape and size to the internal teeth and grooves of the female receiver 65. The external teeth of the male shaft 24 are received within the grooves of the female receiver 65 and the internal teeth of the female receiver 65 are received within the grooves of the male shaft 24 and this rotor/driveshaft coupling releasably couples the driveshaft to the rotor 60 allowing transfer of torque so that rotation of the driveshaft rotates the rotor 60 and vise versa.

In downhole operation, mud pumped from the surface by pump 2 flows between the probe 26 and the sub 27 and along the outer surface of the rotor body 61. When the mud hits the rotor disc 62 it passes through the rotor flow channels 63 and turbine flow channels 67. As the turbine flow channels 67 are angled or sloped relative to the direction of mud flow, mud flowing through the turbine flow channels 67 causes the rotor 60 to rotate continuously in one direction. In the embodiments of the fluid pressure pulse generator 30 shown in FIGS. 2 to 5 and 7 to 9, the rotor 60 rotates counter-clockwise; however in alternative embodiments the side walls of the rotor turbine projections 66 may be angled or sloped in the other direction resulting in clockwise rotation of the rotor 60.

Figure 2A:
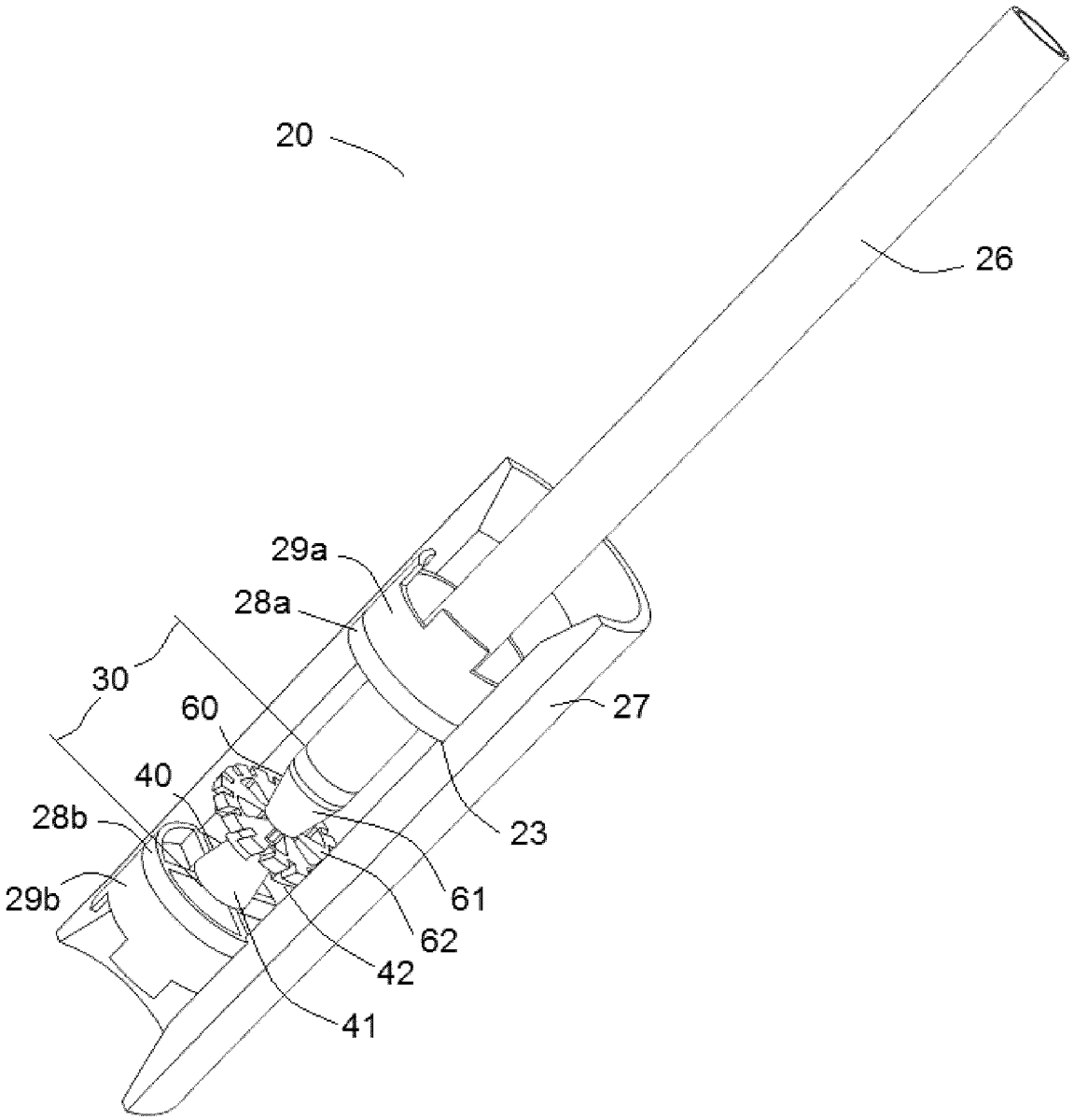
FIG. 2*a* is a perspective view and FIG. 2*b* is a side view of a sub enclosing a downhole end of an assembled MWD tool comprising a probe and a fluid pressure pulse generator comprising a stator and a rotor in accordance with an embodiment.
Figure 2B:
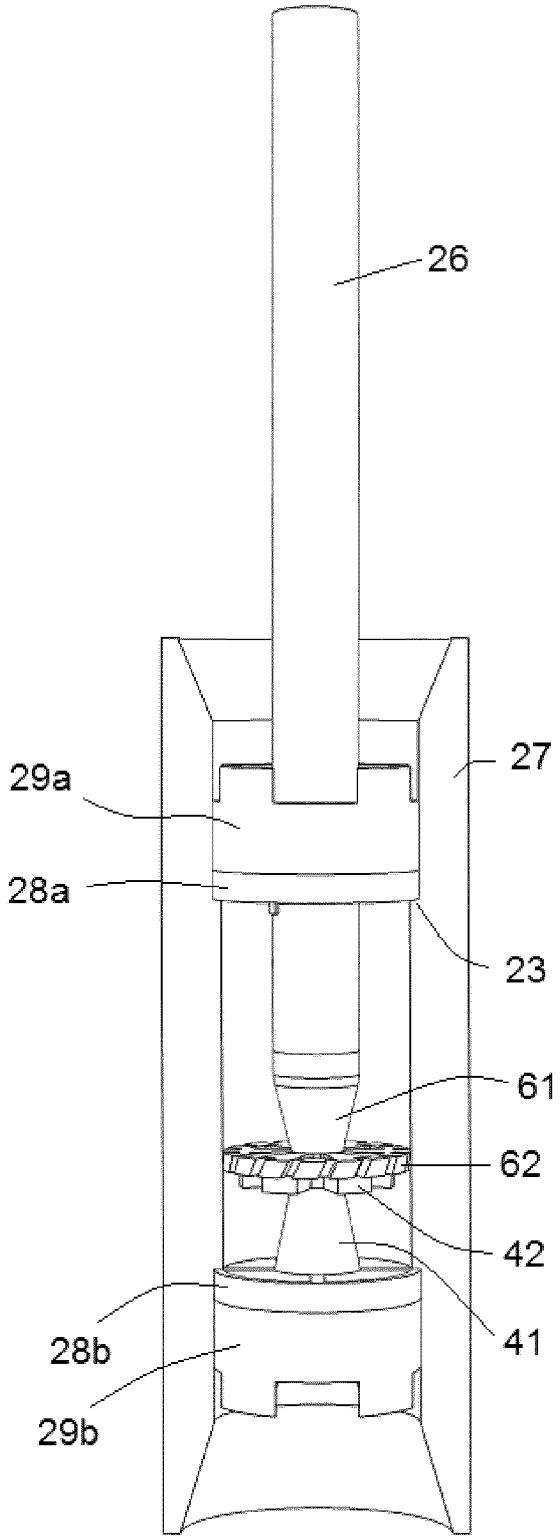
Figure 3A:
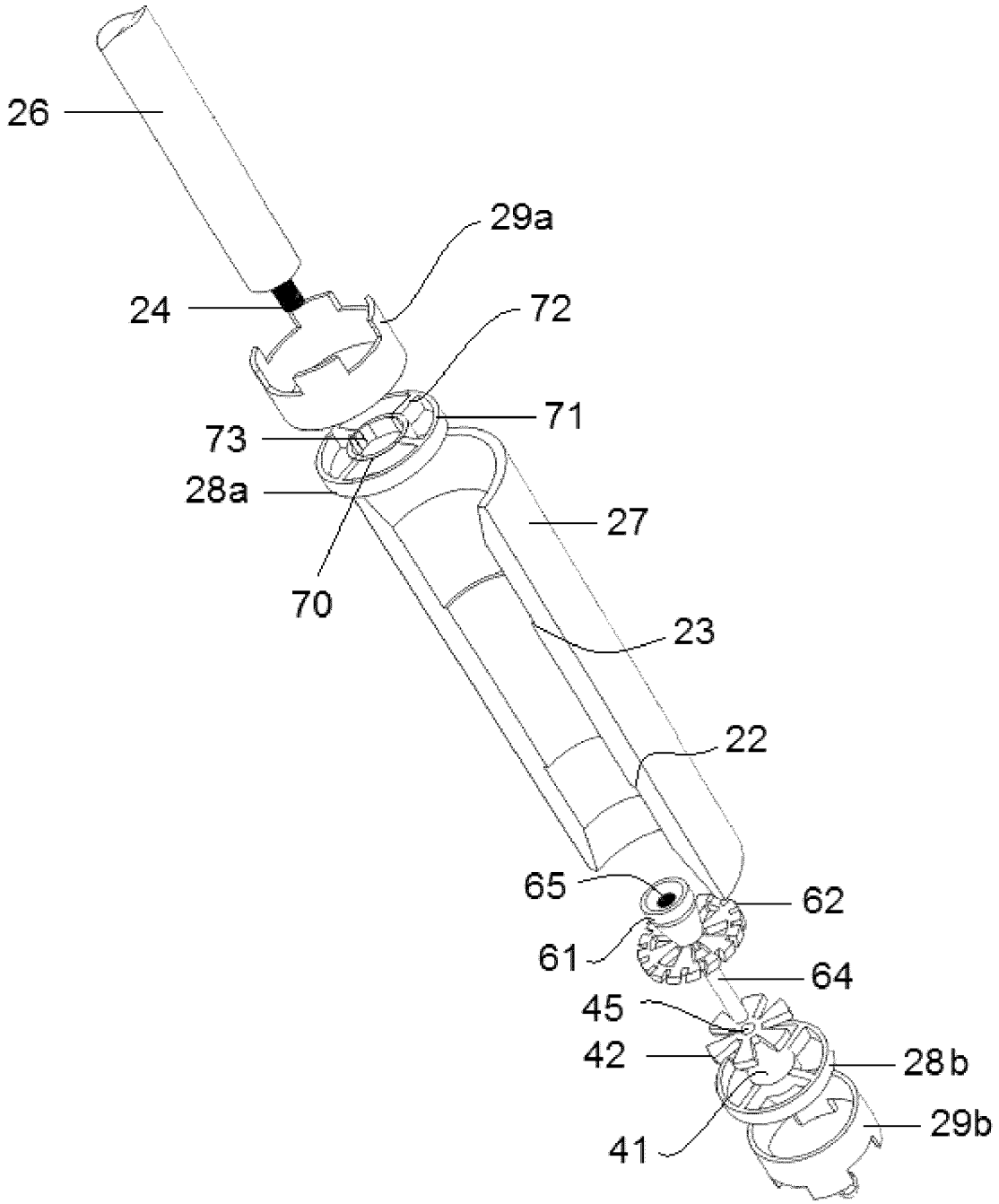
FIG. 3*a* is a perspective view and FIG. 3*b* is a side view of the expanded MWD tool.
Figure 3B:
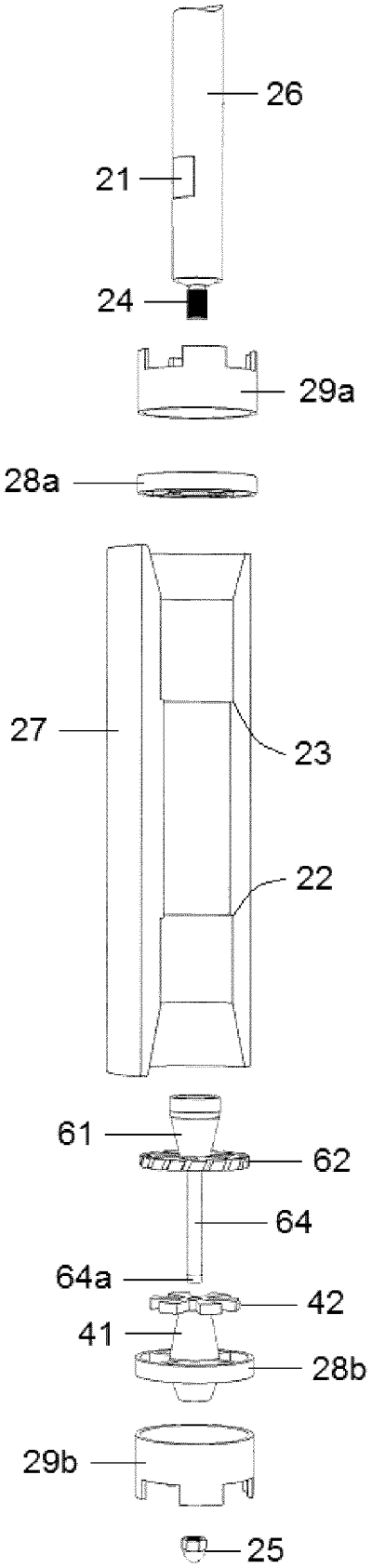

When the rotor flow channels 63 and the stator flow channels 43 align (as shown in FIGS. 2*a* and 2*b*) mud flows through the aligned rotor and stator flow channels 63, 43 and no pressure pulse is generated. As the rotor 60 rotates the rotor flow channels 63 move out of alignment with the stator flow channels 43 and there is restriction of mud flowing through the fluid pressure pulse generator 30 and a pressure pulse 6 is generated. Continuous rotation of the rotor 60 in one direction caused by mud flowing through the turbine flow channels 67 generates a plurality of pressure pulses 6 as the rotor flow channels 63 move in and out of fluid communication with the stator flow channels 43.

The probe 26 generally houses a motor subassembly (not shown) in electrical communication with an electronics subassembly (not shown). The motor subassembly comprises a motor and gearbox subassembly coupled with the driveshaft. The electronics subassembly includes downhole sensors, control electronics, and other components required by the MWD tool 20 to determine direction and inclination information and to take measurements of drilling conditions, to encode this telemetry data using one or more known modulation techniques into a carrier wave. A controller in the electronics subassembly controls timing of rotation of the rotor 60 so that the pressure pulses 6 transmitted to the surface represent the carrier wave and can be decoded to provide an indication of downhole conditions while drilling. Rotational timing of the rotor 60 may be controlled by any means known in the art, for example, by changing the motor speed or braking.

The angled turbine flow channels 67 cause the rotor 60 to rotate when mud flows through the turbine flow channels 67, thereby conserving battery power. Rotation of the rotor 60 as a result of mud flowing through the turbine flow channels 67 may also generate power for the MWD tool 20. The rotor 60 is coupled to the motor and gearbox subassembly through the driveshaft by the rotor/driveshaft coupling and any generated power can be stored in a capacitor bank or battery or diverted to another power draining component within the MWD tool 20. The turbine flow channels 67 also provide a bypass flow area and mud flows through the turbine flow channels 67 regardless of alignment or non-alignment of the rotor flow channels 63 with the stator flow channels 43. This bypass flow area may reduce pressure build up at the fluid pressure pulse generator 30, especially in high mud flow conditions downhole, which may beneficially reduce damage to the fluid pressure pulse generator 30 that could result from mud pressure build up.

Figure 5:
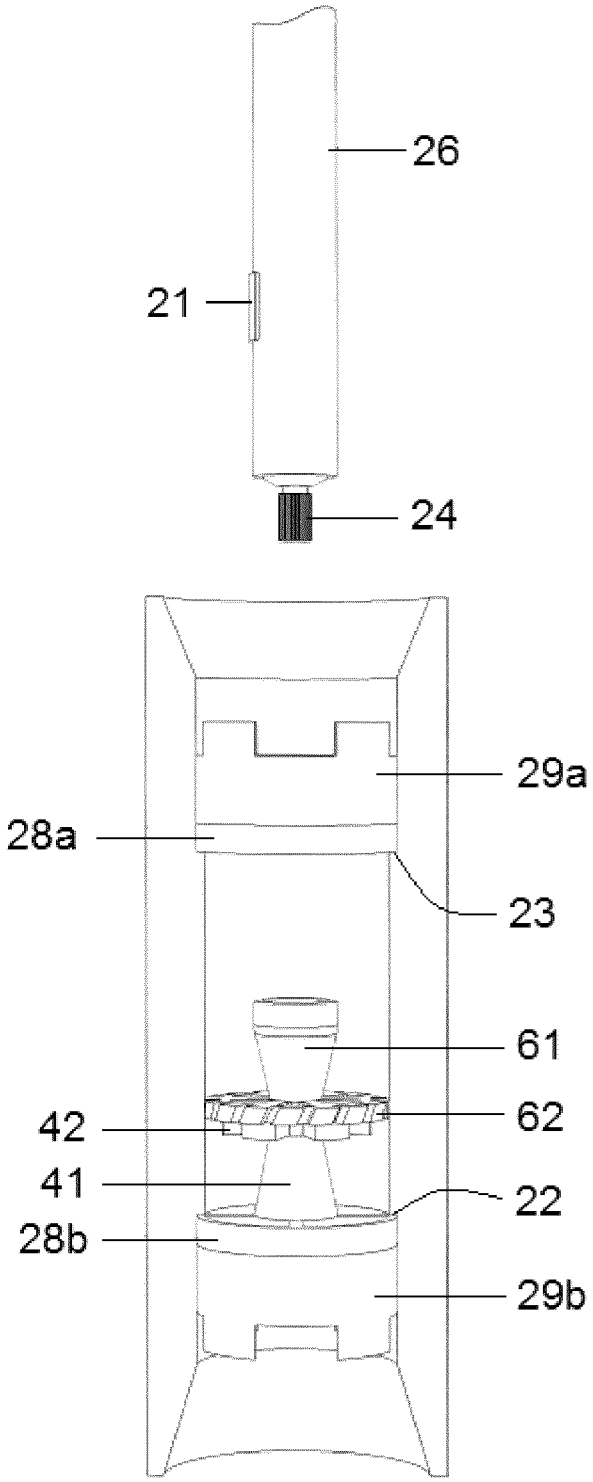
FIG. 5 is a side view of the MWD tool with the fluid pressure pulse generator fixed to the sub and the probe disengaged from the rotor and removed from the sub.

The stator 40 is fixed to the sub 27 by castle nut 29*b* and the rotor 60 is releasably coupled to the stator 40 via nut 25 and is able to rotate relative to the fixed stator 40. The probe 26 and fluid pressure pulse generator 30 are releasably mated through the rotor/driveshaft coupling. The probe 26 may need to be removed from the sub 27 for various purposes, for example uploading of data, programming and calibration of electrical components, repair and the like. As shown in FIG. 5, the probe 26 can be withdrawn from the sub 27 leaving the fluid pressure pulse generator 30 fixed to the sub 27 by castle nut 29*b*. Spider 28*a* and castle nut 29*a* may also remain fixed to the sub 27 as shown in FIG. 5. To position the probe 26 back in the sub 27 the male shaft 24 of the probe is lined up and received within the female receiver 65 of the rotor body 61 and the key 21 on the external surface of the probe 26 is received in the keyway 73 of the spider 28*a* to respectively releasably couple the driveshaft of the probe 26 with the rotor 60 and radially lock the probe 26 to the sub 27.

Referring now to FIGS. 6A-6E, there is shown alternative embodiments of the rotor 60. In each embodiment the rotor 60 comprises rotor body 61 with female receiver 65 therein, a rotor shaft 64 with downhole threaded end 64*a* and a rotor flow diverter. In the embodiments shown in FIGS. 6B, 6D and 6E, the rotor flow diverter comprises rotor disc 62 which extends radially around the rotor body 61 and includes a plurality of rotor flow channels 63 therethrough. In the embodiments shown in FIGS. 6A and 6C, the rotor flow diverter comprises a plurality of radially extending rotor fins or projections 80 defining rotor flow channels 63 therebetween.

Figure 6:
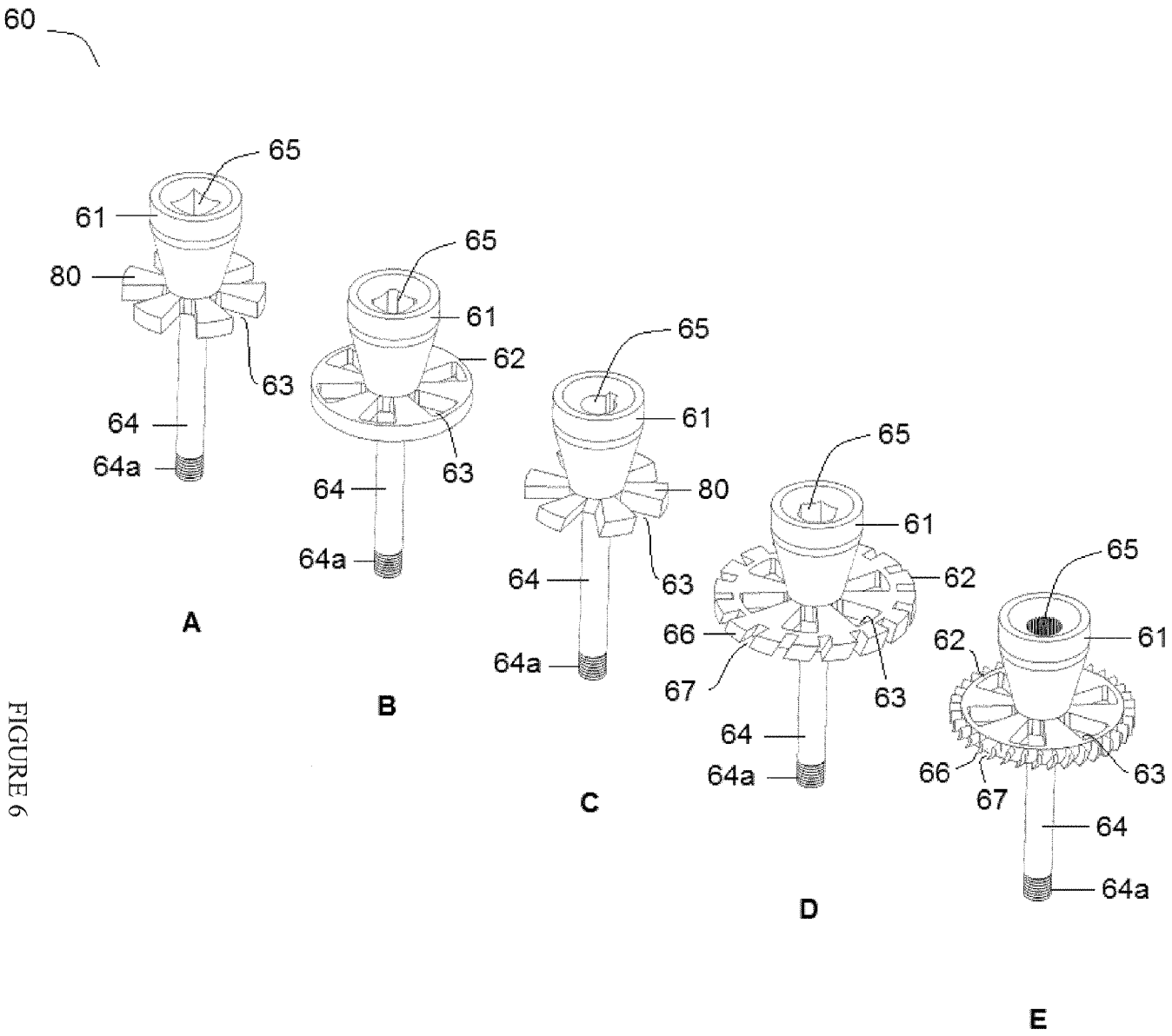
FIGS. 6A-6E are perspective views of different embodiments of the rotor of the fluid pressure pulse generator.
Figure 7:
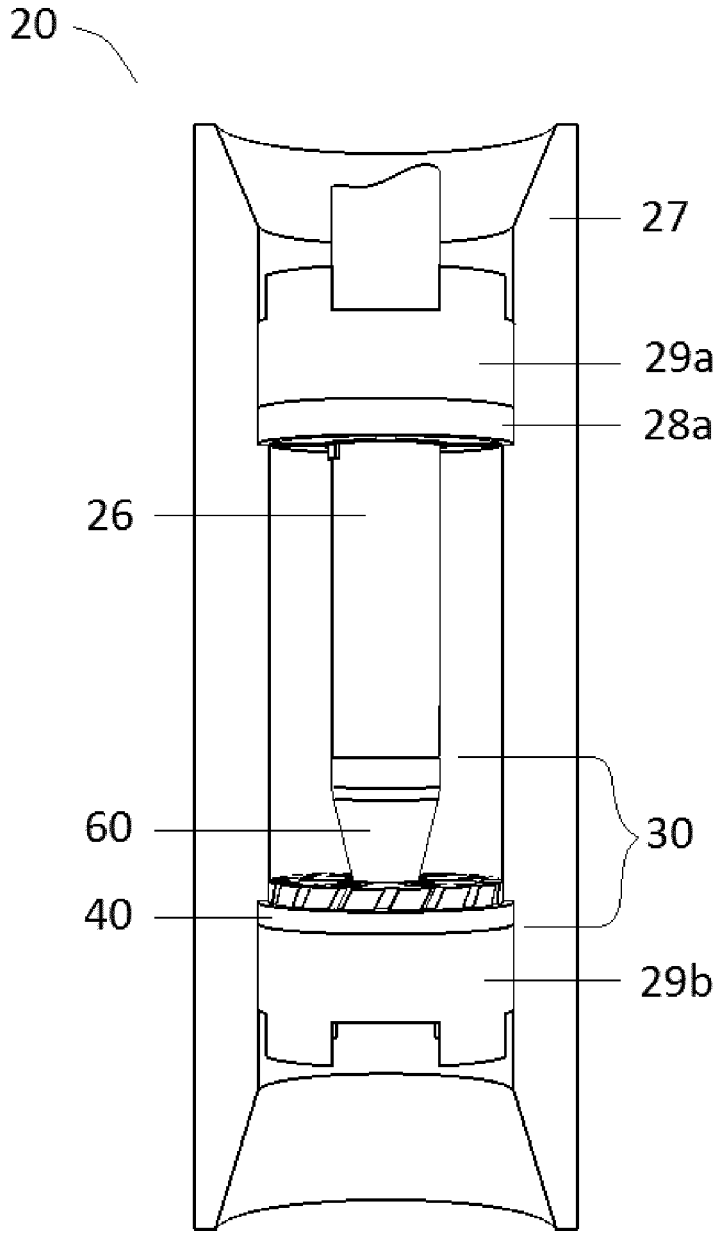
FIG. 7 is a side view of the assembled MWD tool with a stator according to an alternative embodiment.

The female receiver 65 in the rotor body 61 varies in shape in the embodiments of the rotor 60 shown in FIGS. 6A-6E. More specifically, FIG. 6A has a square shaped female receiver 65; FIG. 6B has a square shaped female receiver 65 with rounded edges; FIG. 6C has a circular female receiver 65 with a single keyway; FIG. 6D has a hexagonal shaped female receiver 65; and the female receiver 65 of FIG. 6E has a plurality of parallel teeth with grooves therebetween spaced around the wall of the female receiver 65 the same as the female receiver 65 of the rotor 60 shown in FIGS. 2 to 5 and 7 to 9. In each of the embodiments of the rotor 60 shown in FIGS. 6A-6E, the female receiver 65 receives male shaft 24 which is fixed to or part of the driveshaft of the probe 26. The external profile of the male shaft 24 corresponds to the internal profile of the female receiver 65 and the male shaft 24 is releasably received in the female receiver 65 and releasably couples the driveshaft to the rotor 60 such that rotation of the driveshaft rotates the rotor 60 and vise versa. It will be apparent to a person of skill in the art, that the profile of the rotor female receiver 65 and corresponding driveshaft male shaft 24 may be any shape that allows the male shaft 24 to releasably mate with female receiver 65 and couples the driveshaft of the probe 26 with the rotor 60 for transfer of torque so that rotation of the driveshaft rotates the rotor 60 and vise versa.

In alternative embodiments (not shown) the rotor/driveshaft coupling may be provided by a male shaft which is fixed to, or part of, the rotor 60 and a female receiver which is fixed to, or part of, the driveshaft of the probe 26. The innovative aspects apply equally in embodiments such as these.

In the embodiments of the rotor 60 shown in FIGS. 6D and 6E, the rotor disc 62 further comprises a plurality of turbine projections 66 spaced around the circumference of the rotor disc 62. The turbine projections 66 are angled or sloped relative to the axis of rotation of the rotor 60 and define turbine flow channels 67 therebetween which are also angled relative to the axis of rotation of the rotor 60. Mud flowing through the angled turbine flow channels 67 causes the rotor 60 to rotate continuously in one direction with the direction of rotation determined by the direction of the angled turbine flow channels 67. In the embodiment of the rotor 60 shown in FIG. 6D, the turbine projections 66 are the same as the turbine projections 66 of the rotor 60 shown in FIGS. 2 to 5 and 7 to 9. In the embodiment of the rotor 60 shown in FIG. 6E, the turbine projections 66 are hydrofoils. For the embodiments of the rotor 60 shown in FIGS. 6D and 6E, the rotor rotates counter clockwise when mud is flowing through the turbine flow channels 67. In alternative embodiments the turbine projections 66 may be angled the opposite way and the rotor 60 will rotate clockwise. In further alternative embodiments, the turbine projections 66 may be any shape that results in turbine flow channels 67 defined by the turbine projections 66 being angled or offset (i.e. not parallel) relative to the axis of rotation of the rotor 60 (i.e. the direction of flow of the mud) such that mud flowing through the angled turbine flow channels 67 causes the rotor 60 to rotate in either clockwise or counterclockwise direction. In alternative embodiments (not shown), the turbine projections 66 may be adjustable to adjust the angle of the turbine flow channels 67 relative to the axis of rotation of the rotor 60 to adjustably increase or decrease the amount of rotational force caused by mud flowing through the turbine flow channels 67. In alternative embodiments, the turbine flow channels 67 may extend through any part of the rotor disc 62 and may not be provided by turbine projections 66. The one or more than one turbine flow channel 67 is angled relative to the axis of rotation of the rotor which causes the rotor disc 62 (and thus the rotor 60) to rotate when mud flows through the one or more than one turbine flow channel 67.

In the embodiment of the rotor 60 shown in FIG. 6C, the rotor fins 80 comprise an uphole surface and a downhole surface with two side walls extending therebetween. The side walls are each angled or sloped relative to the axis of rotation of the rotor 60 and define the rotor flow channels 63 therebetween. The rotor flow channels 63 are therefore angled relative to the axis of rotation of the rotor 60 and mud flowing through the angled rotor flow channels 63 hits the sloped side walls of the rotor fins 80 and causes the rotor 60 to rotate continuously counter clockwise. In an alternative embodiment, the side walls may be sloped in the other direction causing continuous clockwise rotation of the rotor 60. The rotor fins 80 or rotor disc 62 may have any profile that results in the rotor flow channels 63 being angled relative to the axis of rotation of the rotor 60 such that mud flowing through the rotor flow channels 63 causes the rotor 60 to rotate. In further alternative embodiments (not shown) the rotor flow diverter may include one or more than one rotor flow channel 63 which is angled relative to the axis of rotation of the rotor 60 and moves in and out of fluid communication with the stator flow channel(s) 43, as well as one or more than one additional turbine flow channel 67 which is also angled relative to the axis of rotation of the rotor 60.

In the embodiments of the rotor 60 shown in FIGS. 6A and 6B, there are no turbine projections 66 and the walls defining the rotor flow channels 63 are parallel to the axis of rotation of the rotor 60, therefore mud flowing through the rotor flow channels 63 does not cause the rotor 60 to rotate. Instead, the motor and gearbox subassembly rotates the driveshaft which is coupled to the rotor 60 by the rotor/driveshaft coupling.

The turbine flow channels 67 of the embodiments of the rotor 60 shown in FIGS. 6D and 6E provide a bypass flow area and mud flows through the turbine flow channels 67 regardless of alignment or non-alignment of the rotor flow channels 63 with the stator flow channels 43. In the embodiments of the rotor 60 shown in FIGS. 6A-6C, the diameter of the rotor flow diverter is less than the internal diameter of the sub 27; this provides a bypass flow area around the circumference of the rotor flow diverter and mud flows between the rotor flow diverter and the sub 27 regardless of alignment or non-alignment of the rotor flow channels 63 with the stator flow channels 43. As discussed above, provision of a bypass flow area may reduce pressure build up at the fluid pressure pulse generator 30, especially in high mud flow conditions downhole, which may beneficially reduce damage to the fluid pressure pulse generator 30 caused by mud pressure build up. In alternative embodiments however, there may be no bypass flow area.

It will be evident from the foregoing that provision of more stator flow channels 43 and rotor flow channels 63 will reduce the amount of rotation required to move the rotor flow channels 63 in and out of fluid communication with the stator flow channels 43, thereby increasing the speed of data transmission. In order to accommodate more stator flow channels 43 and rotor flow channels 63 if data transmission speed is an important factor, the width of the stator flow channels 43 and rotor flow channels 63 can be decreased to allow for more stator flow channels 43 and rotor flow channels 63 to be present; however this may make the stator flow diverter and/or rotor flow diverter more fragile and prone to wear. Furthermore, provision of larger flow channels 43, 63 may allow debris in the mud to pass through the flow channels 43, 63 without the channels becoming blocked.

Provision of multiple stator flow channels 43 and rotor flow channels 63 provides redundancy and allows the fluid pressure pulse generator 30 to continue working when there is damage in the area of or blockage of one of the stator flow channels 43 and/or rotor flow channels 63. Cumulative flow of mud through the remaining undamaged or unblocked stator flow channels 43 and rotor flow channels 63 may still result in generation of detectable pressure pulses 6, even though the pulse heights may not be the same as when there is no damage or blockage. In an alternative embodiment (not shown), the rotor flow channels 63 may be narrower or wider than the stator flow channels 43 and the flow channels 63, 43 need not be of corresponding number, size or shape. In a further alternative embodiment (not shown), the rotor flow diverter may include only a single rotor flow channel 63 which rotates in and out of fluid communication with one or more stator flow channels 43 to generate fluid pressure pulses 6.

The rotor/driveshaft coupling releasably couples the driveshaft and rotor such that the probe 26 can be easily decoupled from the rotor 60 and removed from the sub 27 without the need for any special tools or access to the rotor 60 or driveshaft. In known rotor/stator designs, the stator and the rotor are generally attached to the probe via the driveshaft. By coupling the rotor 60 to the stator 40 and releasably coupling the rotor 60 with the driveshaft of the probe 26, the fluid pressure pulse generator 30 can remain within the sub 27 when the probe 26 is removed as shown in FIG. 5. This may beneficially allow the rotor 60 and stator 40 to be larger than known rotor/stator combinations which may enable generation of larger pulse heights than is generally possible with known rotor/stator designs.

In alternative embodiments (not shown), the stator 40 may be positioned between the rotor 60 and the probe 26 with the stator flow diverter axially adjacent the rotor flow diverter. The rotor body 61 may extend through an aperture in the stator 40 and the male shaft 24 of the driveshaft may be releasably received in the female receiver 65 in the rotor body 61. Alternatively, the rotor 60 may comprise a male shaft (not shown) which extends through an aperture in the stator 40 and is received in a female receiver on or attached to the driveshaft of the probe 26. In each of these alternative embodiments the stator 40 and the rotor 60 are coupled such that the rotor flow diverter can rotate relative to the stator flow diverter and the rotor/driveshaft coupling releasably couples the driveshaft to the rotor 60 allowing transfer of torque so that rotation of the driveshaft rotates the rotor 60 and vise versa.

While particular embodiments have been described in the foregoing, it is to be understood that other embodiments are possible and are intended to be included herein. It will be clear to any person skilled in the art that modifications of and adjustments to the foregoing embodiments, not shown, are possible. For example, in alternative embodiments (not shown), the fluid pressure pulse generator 30 may be positioned at the uphole end of the MWD tool 20.

The invention claimed is:

1. A fluid pressure pulse generator for a downhole telemetry tool, comprising:

(a) a stator comprising a stator flow diverter radially extending across a flow path for fluid flowing through the fluid pressure pulse generator and having one or more than one stator flow channel therethrough through which the fluid flows; and (b) a rotor comprising:

a rotor flow diverter radially extending across the flow path for fluid flowing through the fluid pressure pulse generator and having one or more than one rotor flow channel therethrough through which the fluid flows; and one of a rotor male shaft or a rotor female receiver configured to respectively releasably mate with a driveshaft female receiver or a driveshaft male shaft of a driveshaft of a probe of the downhole telemetry tool to releasably couple the driveshaft with the rotor, wherein the rotor flow diverter is axially adjacent the stator flow diverter and the rotor flow diverter is rotatable relative to the stator flow diverter to move the one or more than one rotor flow channel in and out of fluid communication with the one or more than one stator flow channel to create fluid pressure pulses in the fluid flowing through the fluid pressure pulse generator, and wherein the rotor flow diverter further comprises one or more than one turbine flow channel therethrough, wherein the one or more than one turbine flow channel is angled relative to the axis of rotation of the rotor such that fluid flowing through the one or more than one turbine flow channel causes the rotor to rotate.

2. The fluid pressure pulse generator of claim 1, wherein the rotor comprises the rotor female receiver.

3. The fluid pressure pulse generator of claim 1, wherein the rotor further comprises a rotor body and the rotor flow diverter comprises a plurality of radially extending rotor projections spaced around the rotor body, whereby adjacently spaced rotor projections define the rotor flow channels therebetween.

4. The fluid pressure pulse generator of claim 1, wherein the rotor flow diverter comprises a rotor disc with the one or more than one rotor flow channel extending therethrough.

5. A fluid pressure pulse generator for a downhole telemetry tool, comprising:

(a) a stator comprising a stator flow diverter radially extending across a flow path for fluid flowing through the fluid pressure pulse generator and having one or more than one stator flow channel therethrough through which the fluid flows; and (b) a rotor comprising:

a rotor flow diverter radially extending across the flow path for fluid flowing through the fluid pressure pulse generator and having one or more than one rotor flow channel therethrough through which the fluid flows; and one of a rotor male shaft with a plurality of ridges on an external surface thereof or a rotor female receiver with a plurality of ridges on an internal surface thereof, wherein the rotor flow diverter is axially adjacent the stator flow diverter and the rotor flow diverter is rotatable about an axis of rotation relative to the stator flow diverter to move the one or more than one rotor flow channel in and out of fluid communication with the one or more than one stator flow channel to create fluid pressure pulses in the fluid flowing through the fluid pressure pulse generator, wherein the plurality of ridges include grooves therebetween and are parallel to the axis of rotation of the rotor, wherein the rotor flow diverter further comprises one or more than one turbine flow channel therethrough, and wherein the one or more than one turbine flow channel is angled relative to the axis of rotation of the rotor such that fluid flowing through the one or more than one turbine flow channel causes the rotor to rotate.

6. The fluid pressure pulse generator of claim 5, wherein the rotor flow diverter comprises a rotor disc with the one or more than one rotor flow channel extending therethrough and a plurality of turbine projections spaced around a circumference of the rotor disc, whereby adjacently spaced turbine projections define the turbine flow channels therebetween.

7. The fluid pressure pulse generator of claim 1, wherein one or more of the one or more than one rotor flow channel is angled relative to the axis of rotation of the rotor such that fluid flowing through the one or more than one rotor flow channel causes the rotor to rotate.

8. The fluid pressure pulse generator of claim 1, wherein the rotor further comprises a longitudinally extending rotor shaft which is received in a bore extending through the stator.

9. The fluid pressure pulse generator of claim 8, further comprising a fastener configured to fasten to the rotor shaft to retain the rotor shaft in the bore while allowing rotation of the rotor shaft within the bore.

10. The fluid pressure pulse generator of claim 9, wherein the fastener is configured to releasably fasten to the rotor shaft.

11. The fluid pressure pulse generator of claim 10, wherein the fastener is a threaded nut and the rotor shaft is threaded to receive the threaded nut.

12. The fluid pressure pulse generator of claim 1, wherein the stator further comprises a stator body and the stator flow diverter comprises a plurality of radially extending stator projections spaced around the stator body, whereby adjacently spaced stator projections define the stator flow channels therebetween.

13. The fluid pressure pulse generator of claim 12, further comprising a spider configured to extend between the stator body and a sub when the downhole telemetry tool is downhole, the spider comprising a plurality of apertures for flow of fluid therethrough.

14. The fluid pressure pulse generator of claim 13, further comprising a castle nut for releasably securing the spider to the sub.

15. The fluid pressure pulse generator of claim 1, wherein the stator flow diverter comprises a stator disc with the one or more than one stator flow channel extending therethrough.

16. The fluid pressure pulse generator of claim 15, further comprising a castle nut for releasably securing the stator disc to a sub when the downhole telemetry tool is downhole.

17. A downhole telemetry tool comprising:

a probe comprising:

(a) a housing enclosing a motor and gearbox subassembly; and (b) a driveshaft having a first end coupled with the motor and gearbox subassembly and an opposed second end extending out of the housing and comprising a driveshaft female receiver or a driveshaft male shaft; and a fluid pressure pulse generator comprising:

(a) a stator comprising a stator flow diverter radially extending across a flow path for fluid flowing through the fluid pressure pulse generator and having one or more than one stator flow channel therethrough through which the fluid flows; and (b) a rotor comprising:

a rotor flow diverter radially extending across the flow path for fluid flowing through the fluid pressure pulse generator and having one or more than one rotor flow channel therethrough through which the fluid flows; and a rotor male shaft or a rotor female receiver, wherein the rotor flow diverter is axially adjacent the stator flow diverter and the rotor flow diverter is rotatable relative to the stator flow diverter to move the one or more than one rotor flow channel in and out of fluid communication with the one or more than one stator flow channel to create fluid pressure pulses in the fluid flowing through the fluid pressure pulse generator, wherein the probe comprises the driveshaft male shaft and the rotor comprises the rotor female receiver, or the probe comprises the driveshaft female receiver and the rotor comprises the rotor male shaft, whereby the driveshaft male shaft and the rotor female receiver or the driveshaft female receiver and the rotor male shaft releasably mate to releasably couple the driveshaft with the rotor, and wherein the rotor flow diverter further comprises one or more than one turbine flow channel therethrough, wherein the one or more than one turbine flow channel is angled relative to the axis of rotation of the rotor such that fluid flowing through the one or more than one turbine flow channel causes the rotor to rotate.

18. The downhole telemetry tool of claim 17, wherein the probe comprises the driveshaft male shaft and the rotor comprises the rotor female receiver.

19. The downhole telemetry tool of claim 17, wherein the rotor further comprises a rotor body and the rotor flow diverter comprises a plurality of radially extending rotor projections spaced around the rotor body, whereby adjacently spaced rotor projections define the rotor flow channels therebetween.

20. The downhole telemetry tool of claim 17, wherein the rotor flow diverter comprises a rotor disc with the one or more than one rotor flow channel extending therethrough.

21. A downhole telemetry tool comprising:

(i) a probe comprising:

(a) a housing enclosing a motor and gearbox subassembly; and (b) a driveshaft having a first end coupled with the motor and gearbox subassembly and an opposed second end extending out of the housing and comprising a driveshaft female receiver with a plurality of ridges on an internal surface thereof or a driveshaft male shaft with a plurality of ridges on an external surface thereof; and (ii) a fluid pressure pulse generator comprising:

(a) a stator comprising a stator flow diverter radially extending across a flow path for fluid flowing through the fluid pressure pulse generator and having one or more than one stator flow channel therethrough through which the fluid flows; and (b) a rotor comprising:

a rotor flow diverter radially extending across the flow path for fluid flowing through the fluid pressure pulse generator and having one or more than one rotor flow channel therethrough through which the fluid flows; and one of a rotor male shaft with a plurality of ridges on an external surface thereof or a rotor female receiver with a plurality of ridges on an internal surface thereof, wherein the rotor flow diverter is axially adjacent the stator flow diverter and the rotor flow diverter is rotatable about an axis of rotation relative to the stator flow diverter to move the one or more than one rotor flow channel in and out of fluid communication with the one or more than one stator flow channel to create fluid pressure pulses in the fluid flowing through the fluid pressure pulse generator, wherein the probe comprises the driveshaft male shaft and the rotor comprises the rotor female receiver, or the probe comprises the driveshaft female receiver and the rotor comprises the rotor male shaft, wherein the plurality of ridges include grooves therebetween and are parallel to the axis of rotation of the rotor whereby the grooves of the female receiver receive the ridges of the male shaft and the grooves of the male shaft receive the ridges of the female receiver to releasably couple the driveshaft with the rotor, wherein the rotor flow diverter further comprises one or more than one turbine flow channel therethrough, wherein the one or more than one turbine flow channel is angled relative to the axis of rotation of the rotor such that fluid flowing through the one or more than one turbine flow channel causes the rotor to rotate.

22. The downhole telemetry tool of claim 21, wherein the rotor flow diverter comprises a rotor disc with the one or more than one rotor flow channel extending therethrough and a plurality of turbine projections spaced around a circumference of the rotor disc, whereby adjacently spaced turbine projections define the turbine flow channels therebetween.

23. The downhole telemetry tool of claim 17, wherein one or more of the one or more than one rotor flow channel is angled relative to the axis of rotation of the rotor such that fluid flowing through the one or more than one rotor flow channel causes the rotor to rotate.

24. The downhole telemetry tool of claim 17, wherein the rotor further comprises a longitudinally extending rotor shaft which is received in a bore extending through the stator.

25. The downhole telemetry tool of claim 24, further comprising a fastener configured to fasten to the rotor shaft to retain the rotor shaft in the bore while allowing rotation of the rotor shaft within the bore.

26. The downhole telemetry tool of claim 25 wherein the fastener is configured to releasably fasten to the rotor shaft.

27. The downhole telemetry tool of claim 26, wherein the fastener is a threaded nut and the rotor shaft is threaded to receive the threaded nut.

28. The downhole telemetry tool of claim 17, wherein the stator further comprises a stator body and the stator flow diverter comprises a plurality of radially extending stator projections spaced around the stator body, whereby adjacently spaced stator projections define the stator flow channels therebetween.

29. The downhole telemetry tool of claim 28, further comprising a stator spider configured to extend between the stator body and a sub when the downhole telemetry tool is downhole, the stator spider comprising a plurality of apertures for flow of fluid therethrough.

30. The downhole telemetry tool of claim 29, further comprising a stator castle nut for releasably securing the stator spider to the sub.

31. The downhole telemetry tool of claim 17, wherein the stator flow diverter comprises a stator disc with the one or more than one stator flow channel extending therethrough.

32. The downhole telemetry tool of claim 31, further comprising a stator castle nut for releasably securing the stator disc to a sub when the downhole telemetry tool is downhole.

33. The downhole telemetry tool of claim 17, further comprising a probe spider configured to releasably receive and radially lock the probe, the probe spider comprising a plurality of apertures for flow of fluid therethrough.

34. The downhole telemetry tool of claim 33, further comprising a probe castle nut for releasably securing the probe spider downhole.

35. The fluid pressure pulse generator of claim 1, wherein the rotor flow diverter comprises a rotor disc with the one or more than one rotor flow channel extending therethrough and a plurality of turbine projections spaced around a circumference of the rotor disc, whereby adjacently spaced turbine projections define the turbine flow channels therebetween.

36. The downhole telemetry tool of claim 17, wherein the rotor flow diverter comprises a rotor disc with the one or more than one rotor flow channel extending therethrough and a plurality of turbine projections spaced around a circumference of the rotor disc, whereby adjacently spaced turbine projections define the turbine flow channels therebetween.

* * * * *